US009162488B2

(12) United States Patent
Lo et al.

(10) Patent No.: US 9,162,488 B2
(45) Date of Patent: Oct. 20, 2015

(54) MEDIA GUIDE

(75) Inventors: Kevin Lo, Vancouver, WA (US); Wesley R Schalk, Camas, WA (US); Paul Coffin, Battle Ground, WA (US)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 14/396,563

(22) PCT Filed: Jun. 26, 2012

(86) PCT No.: PCT/US2012/044176

§ 371 (c)(1),
(2), (4) Date: Oct. 23, 2014

(87) PCT Pub. No.: WO2014/003719

PCT Pub. Date: Jan. 3, 2014

(65) Prior Publication Data

US 2015/0124033 A1 May 7, 2015

(51) Int. Cl.
*B41J 2/01* (2006.01)
*B41J 11/00* (2006.01)

(52) U.S. Cl.
CPC ..... *B41J 11/0045* (2013.01); *B41J 11/005* (2013.01)

(58) Field of Classification Search
CPC .... B41J 25/308; B41J 11/0095; B41J 11/008; B41J 13/103; B41J 29/38; B41J 11/007
USPC ..... 347/8, 16, 40, 42, 49, 101, 104
See application file for complete search history.

(56) References Cited

U.S. PATENT DOCUMENTS

| | | | | |
|---|---|---|---|---|
| 4,601,595 | A | 7/1986 | Aiba et al. | |
| 5,065,169 | A | 11/1991 | Vincent et al. | |
| 5,414,453 | A | 5/1995 | Rhoads et al. | |
| 6,092,949 | A | 7/2000 | Koyabu et al. | |
| 6,416,146 | B1 * | 7/2002 | Chua et al. | 347/8 |
| 7,467,859 | B2 * | 12/2008 | Silverbrook | 347/85 |
| 7,731,319 | B2 * | 6/2010 | Murcia et al. | 347/8 |

FOREIGN PATENT DOCUMENTS

| | | | |
|---|---|---|---|
| CN | 2009069027 | Y | 10/2007 |
| CN | 102139581 | | 8/2011 |
| EP | 0816109 | | 1/1998 |
| JP | 1160664 | A | 6/1989 |
| JP | 6134986 | A | 5/1994 |
| JP | 7125346 | A | 5/1995 |
| JP | 10291316 | A | 11/1998 |
| KR | 20110088350 | | 8/2011 |

OTHER PUBLICATIONS

International Search Authority. International Search Report mail date Feb. 25, 2013. Application No. PCT/US2012/044176 filing date Jun. 26, 2012.

* cited by examiner

*Primary Examiner* — An Do
(74) *Attorney, Agent, or Firm* — Dhand Law PC

(57) ABSTRACT

In one example, a media guide for use with a print bar includes a plate suspended over the print bar to guide a leading edge of print media away from printheads on the print bar during printing when the print bar is installed in a printer.

14 Claims, 16 Drawing Sheets

MEDIA GUIDE

BACKGROUND

In some inkjet printers, a stationary media wide printhead assembly, commonly caned a print bar, is used to print on paper or other print media moved past the print bar.

DRAWINGS

The same pert numbers designate the same or similar parts throughout the figures.

DESCRIPTION

The stationary media wide print bar in an inkjet printer is susceptible to media jams and print quality defects from the print media crashing into the printheads. A new media guide has been developed to help prevent the print media from contacting the printheads during printing. In one example of the new media guide, a series of bumps on the print bar shroud guide the leading edge of the print media away from the printheads during printing. In another example of the new media guide, a series of plates suspended over the print bar guide the print media away from the printheads. In one example, the bumps and the plates are used together to form the media guide—in this example each plate is suspended over the print bar and biased against one or more of the bumps, which function as spacers to maintain the plates at the desired distance over the print bar.

Examples of the new media guide are described with reference to an inkjet printer using a media wide print bar. However, examples of the new media guide are not limited to media wide print bars or inkjet printers but might also be implemented with other print mechanisms and in other inkjet type dispensers. The examples shown in the figures and described below, therefore, illustrate but do not limit the invention, which is defined in the Claims following this Description.

As used in this document, "liquid" means a fluid not composed primarily of a gas or gases; a "platen" means a supporting structure or multiple supporting structures and is not limited to a flat plate; a "printhead" means that part of an inkjet printer or other inkjet type dispenser that dispenses liquid from one or more openings, for example as drops or streams; a "print bar" means a structure or device holding an arrangement of one or more printheads that remains stationary during printing; and "shroud" means a structure configured to protect the printhead(s) or other parts of a print bar against collisions with the print media and/or damage from exposure to contaminants that may be generated in the print zone. "Printhead" and "print bar" are not limited to printing with ink but also include inkjet type dispensing of other liquids and/or for uses other than printing.

Figure 1:
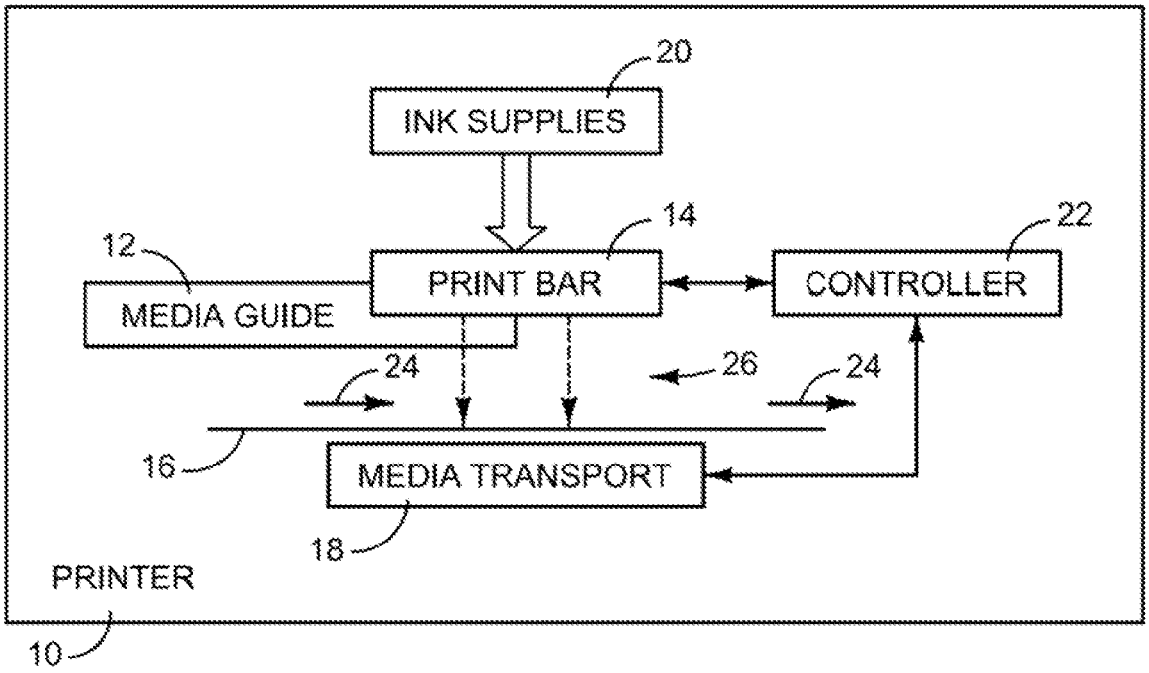
FIG. 1 is a block diagram illustrating an inkjet printer in which examples of a new print media guide may be implemented.

FIG. 1 is a block diagram illustrating an inkjet printer 10 in which examples of a new print media guide 12 may be implemented. Referring to FIG. 1, printer 10 includes a print bar 14 that includes an arrangement of one or more printheads for dispensing ink on to a sheet or continuous web of paper or other print media 16. Printer 10 also includes a print media transport mechanism 18 for moving media 16, an ink supply or multiple supplies 20 for supplying ink to print bar 14, and a printer controller 22. Controller 22 represents generally the programming, processor(s) and associated memories, and the electronic circuitry and components needed to control the operative elements of printer 10. As described in detail below with reference to the examples shown in FIGS. 2-16, me is guide 12 is positioned across an upstream part of print bar 14 (with respect to media path 24) and extends into the print zone 26 to help block media 16 from contacting the printheads in print bar 14.

Figure 2:
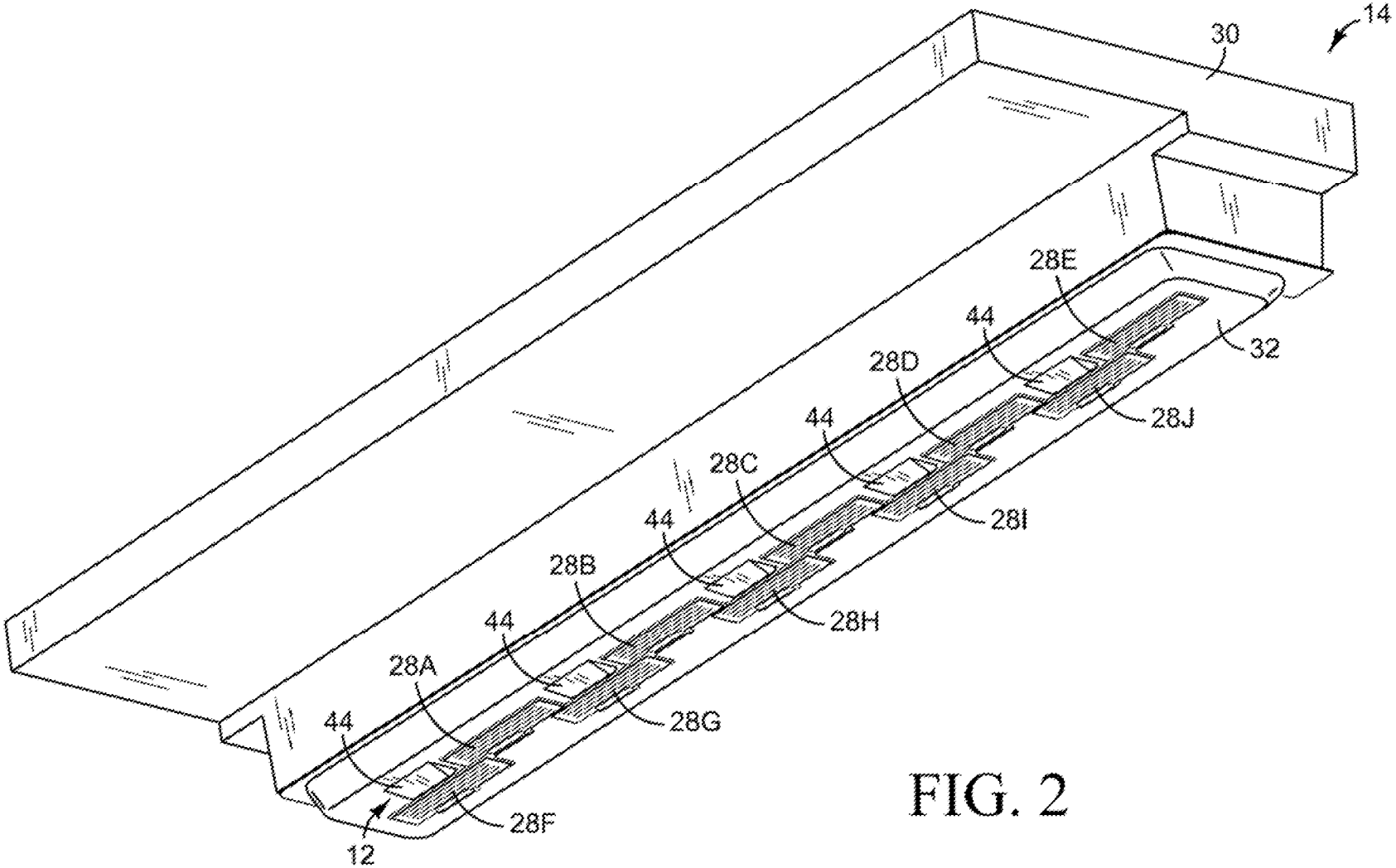
FIG. 2 is a perspective view illustrating one example of a new media guide in which a series of bumps are integrated into the print bar shroud, such as might be used in the printer of FIG. 1.
Figure 3:
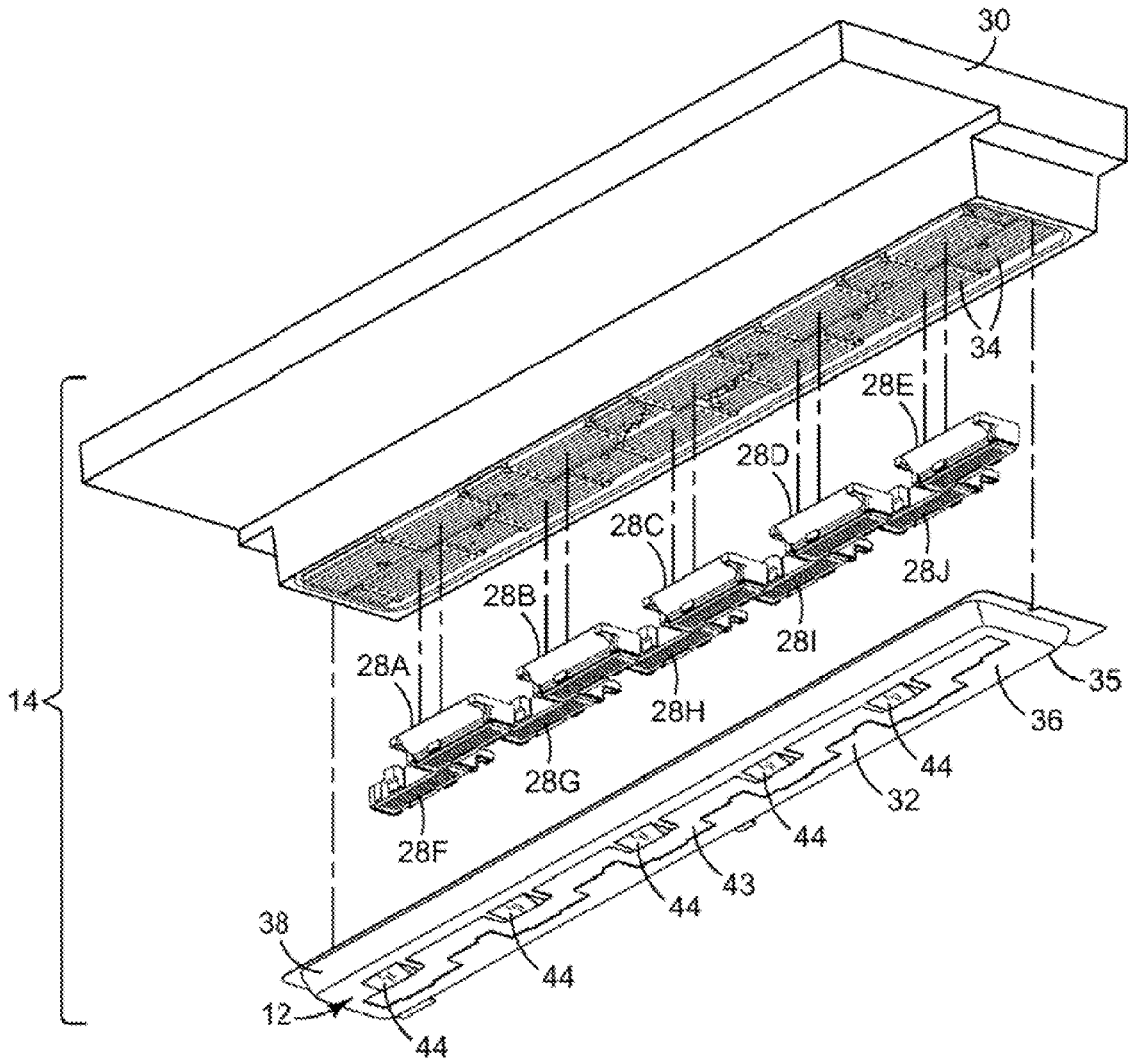
FIG. 3 is an exploded view of the print bar shown in FIG. 2.
Figure 4:
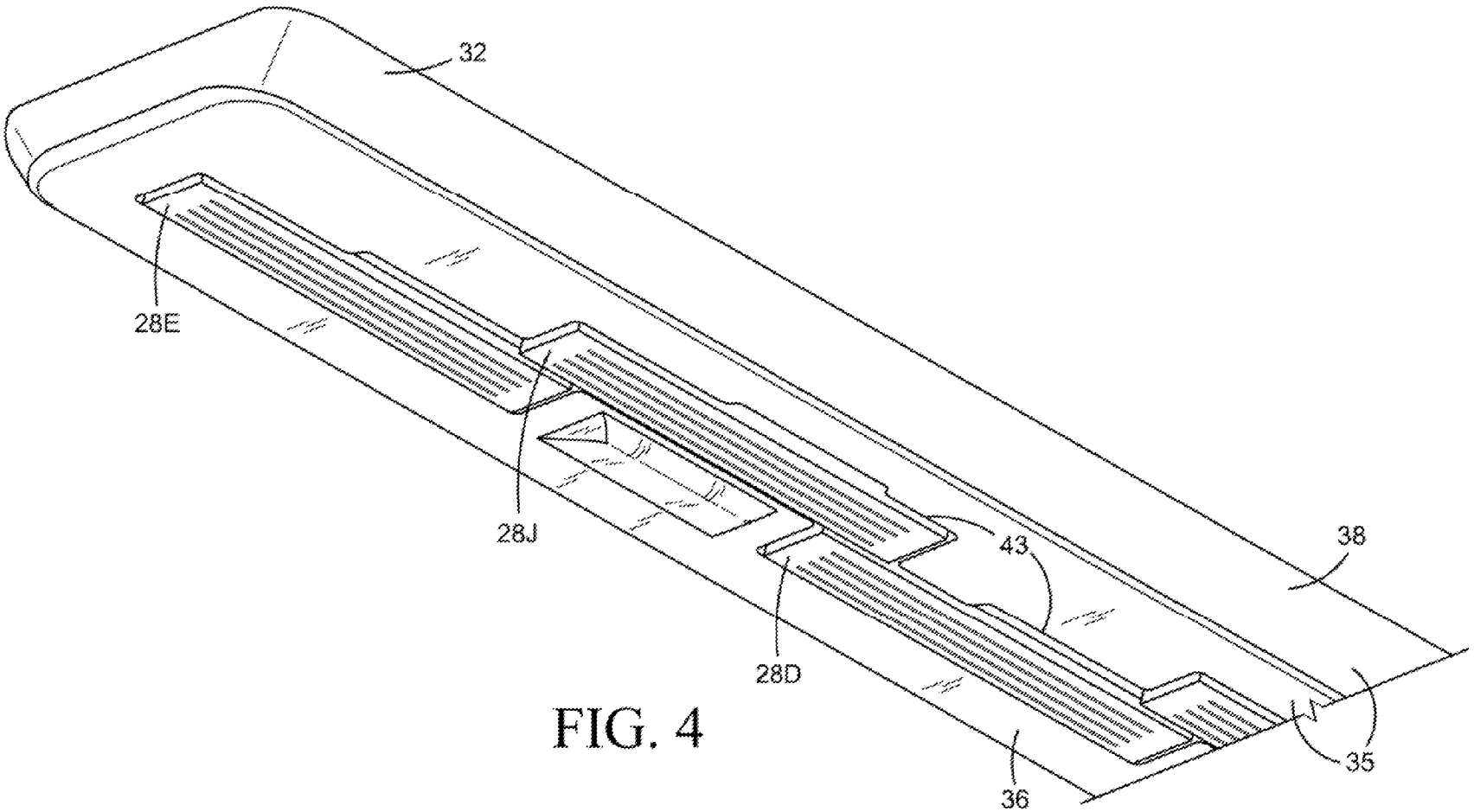
FIG. 4 is a close up view of one of the bumps on the print bar shroud shown in FIGS. 2 and 3.
Figure 5:
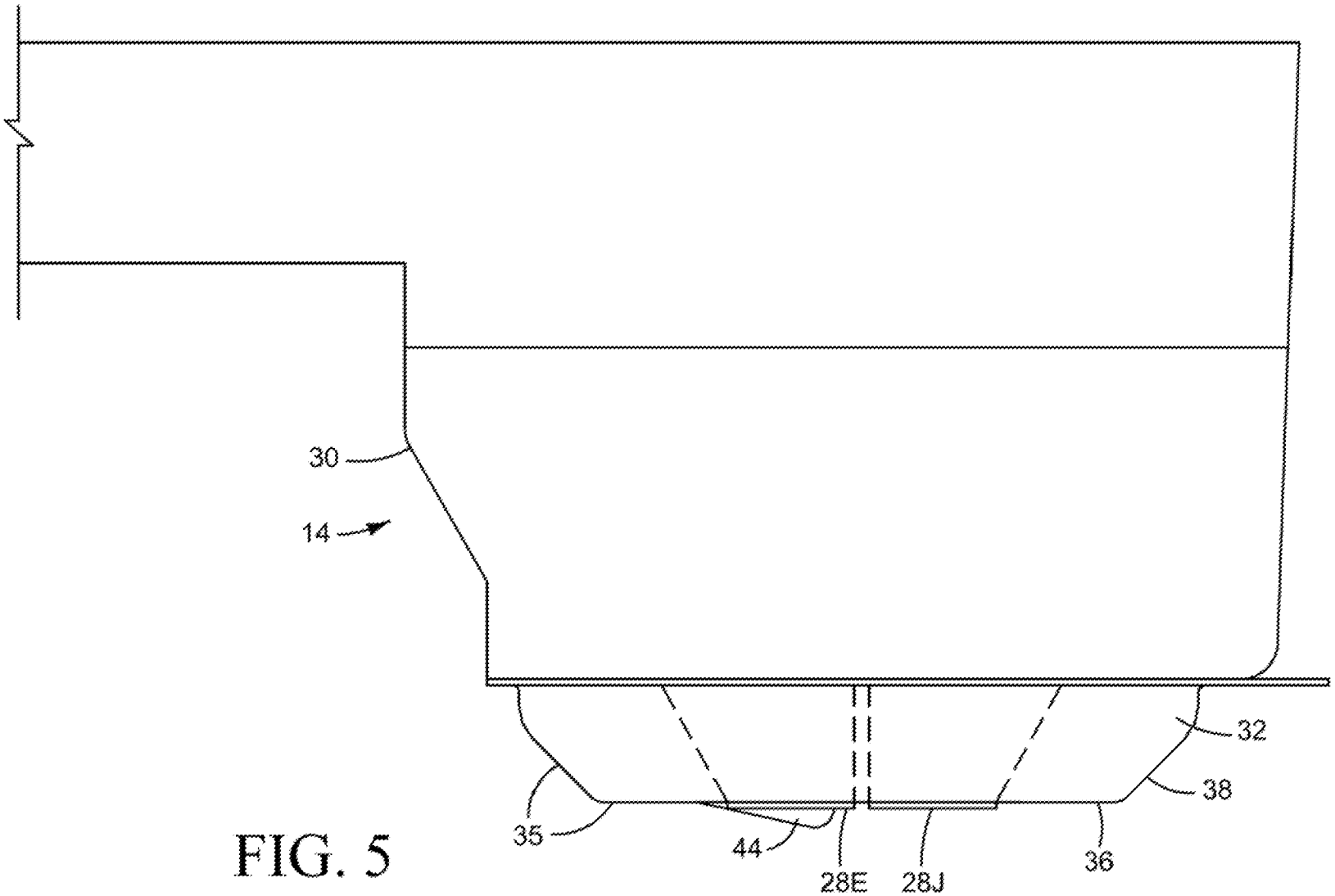
FIG. 5 is a side view of the print bar shown in FIG. 2.
Figure 6:
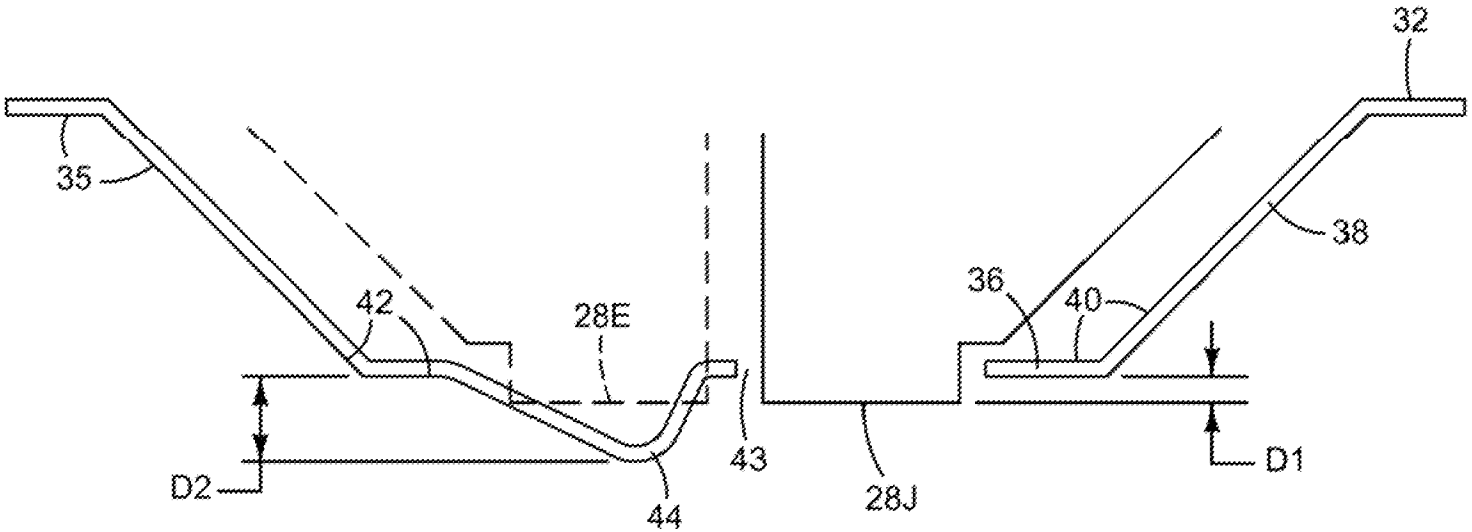
FIG. 6 is a simplified section view illustrating one of the bumps shown in FIGS. 2-4.
Figure 7:
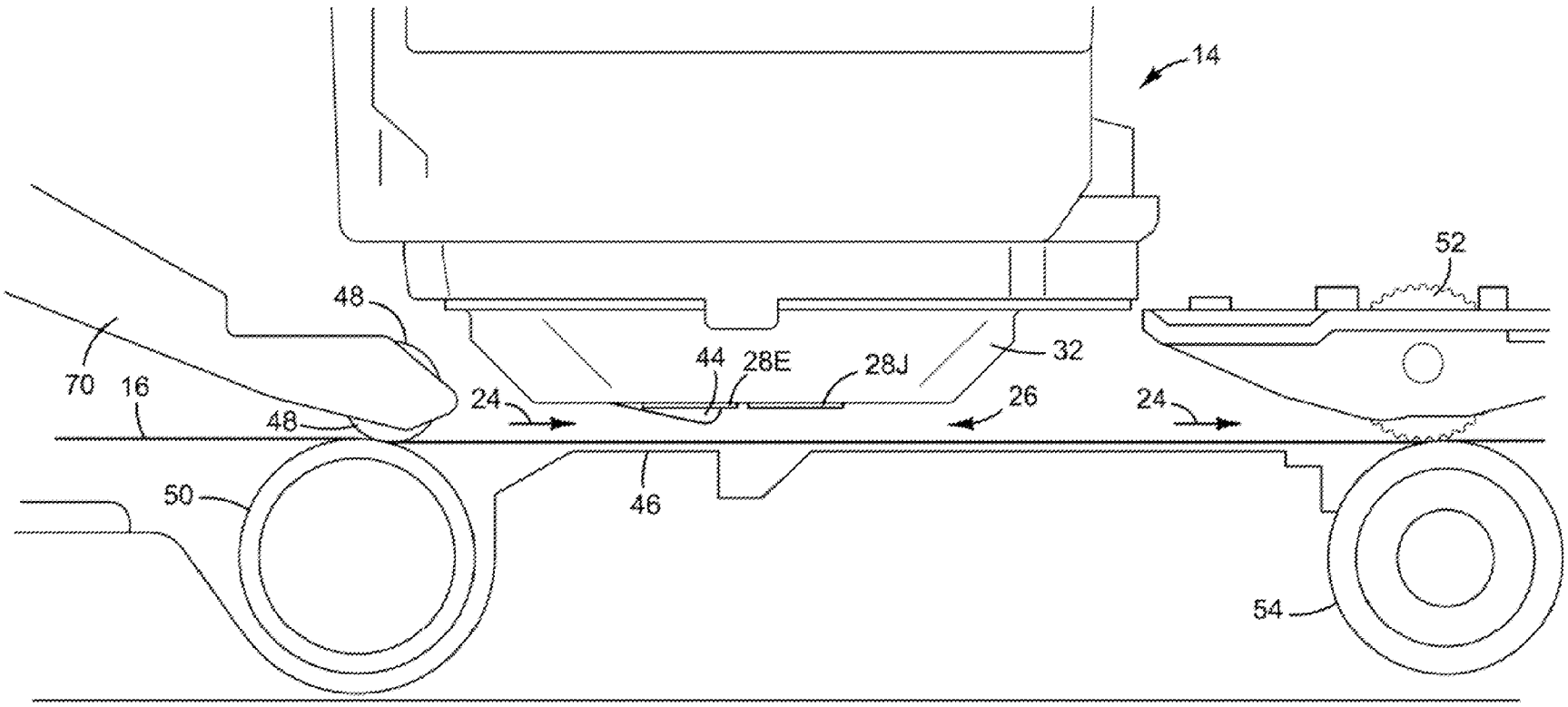
FIG. 7 is a side view illustrating one example print zone in an inkjet printer implementing the print media guide shown in FIGS. 2 and 3.

FIGS. 2 and 3 are perspective views of a print bar 14 implementing one example of a new media guide 12, such as might be used in printer 10 shown in FIG. 1, in which a series of bumps are integrated into the print bar shroud. FIG. 4 is a close up of one of the bumps on the print bar shroud shown in FIGS. 2 and 3. FIG. 5 is a side view of the print bar 12 shown in FIGS. 2 and 3. FIG. 6 is a simplified section view illustrating one of the bumps shown in FIGS. 2-4. FIG. 7 is a side view illustrating one example print zone 26 in an inkjet printer implementing the media guide 12 shown in FIGS. 2-4.

Referring first to FIGS. 2 and 3, a print bar 14 includes multiple printheads 28A-28J mounted to a body 30 and surrounded by a protective shroud 32. Print bar 14 represents, for example, a media wide print bar 14 suitable for one pass color printing. In addition to supporting printheads 28A-28J and shroud 32, print bar body 30 provides the structural support and reference surfaces for accurately mounting print bar 14 in a printer. Print bar body 30 may also house the distribution system for delivering ink to each printhead 28A-28J including, for example, a series of ink channels 34 visible in FIG. 3. Shroud 32 represents generally any suitable structure configured to protect printheads 28A-28J and other parts of print bar 14 against collisions with the print media and/or damage from exposure to ink aerosol, debris, and other contaminants that may be generated in print one 26.

In the example shown, as best seen in FIGS. 3 and 6, shroud 32 includes an elongated body 35 with a flat inboard part 38 and angled or curved outboard parts 38 that together define a generally concave interior surface 40 (FIG. 6) and a generally convex exterior surface 42 (FIG. 6). Each printhead 28A-28J is exposed through an opening 43 in shroud 32 to dispense ink past shroud 32 onto the print media. Printheads 28A-28J are arranged on print bar 14 in a staggered configuration in which the end of each printhead overlaps the end of the adjacent printhead(s). Although it is expected that the printheads will usually be arranged in a staggered, overlapping configuration as shown, other suitable printhead configurations are possible. For example, where the print bar includes only a single media wide printhead and/or where multiple print bars are used, the printhead(s) may be arranged differently. Also, in the example shown, all of the printheads 28A-28J are exposed through a single opening 43 in a stepped configuration corresponding to the staggered, overlapping configuration of the printheads. Other suitable opening configurations are possible. For example, shroud 32 might include multiple openings each configured to expose a corresponding printhead.

Referring to FIGS. 2-7, a series of bumps 44 protrude from the exterior of shroud 32. For the staggered printhead configuration in this example, each bump 44 is positioned immediately upstream from a downstream printhead 28F-28J between two upstream printheads 28A-28E (or next to one upstream printhead 28A for an end bump 44). Referring specifically to FIG. 7, print bar 14 positioned over a media support platen 46 defines a print zone 26 in which ink is dispensed on to the paper or other print media 16. Media transport 18 includes print zone entry rollers 48, 50 and exit rollers 52, 54. In this example, exit rollers 52 are configured as star wheels 52 that help minimize damaging the ink image on media 16 as it exits print zone 26. As best seen in the simplified section view of FIG. 6, each printhead 28A-28J protrudes from shroud 32 a distance D1 and each bump 44 protrudes from shroud 32 as greater distance D2. Thus, each bump 44 blocks the leading edge of print media 16 from crashing in to the protruding downstream printhead 28F-28J and guides the leading edge down, away from all printheads 28A-28J.

In the example shown, in the figures, each bump 44 is configured as a ramp inclined in the downstream direction to more smoothly guide the leading edge of media 16 away from printheads 28A-28J. (Note that "inclined" in this context refers to the increasing distance that the bump protrudes from the shroud, which is downward when the print bar is installed in a printer.) Bumps 44 may be embossed or otherwise formed as an integral pad of shroud 32 or bumps 44 may be discrete parts affixed to shroud 32.

Testing shows that placing bumps 44 at strategic areas along print bar 14, as shown, significantly reduces the instances of print media 16 contacting printheads 28A-28J and/or jamming in print zone 26. As static protrusions that are not easily damaged during jam clearing (as well during normal printing Operations), bumps 44 provide a robust, inexpensive solution to the problems of printhead contact and print zone media jams. Also, static media guides like bumps 44 can be selectively placed in problem areas, and very close to the printheads where they can be wiped clean of debris and ink residue during printhead servicing operations. While testing suggests most media jams occur at downstream printheads for the print bar configuration shown, and thus placing the bumps immediately upstream from the downstream printheads is desirable, it may be desirable for other printhead configurations or in different printing applications to place the bumps at other locations. The placement of bumps 44 shown in FIGS. 2-7 is just one example of a suitable configuration for media guide 12.

Figure 8:
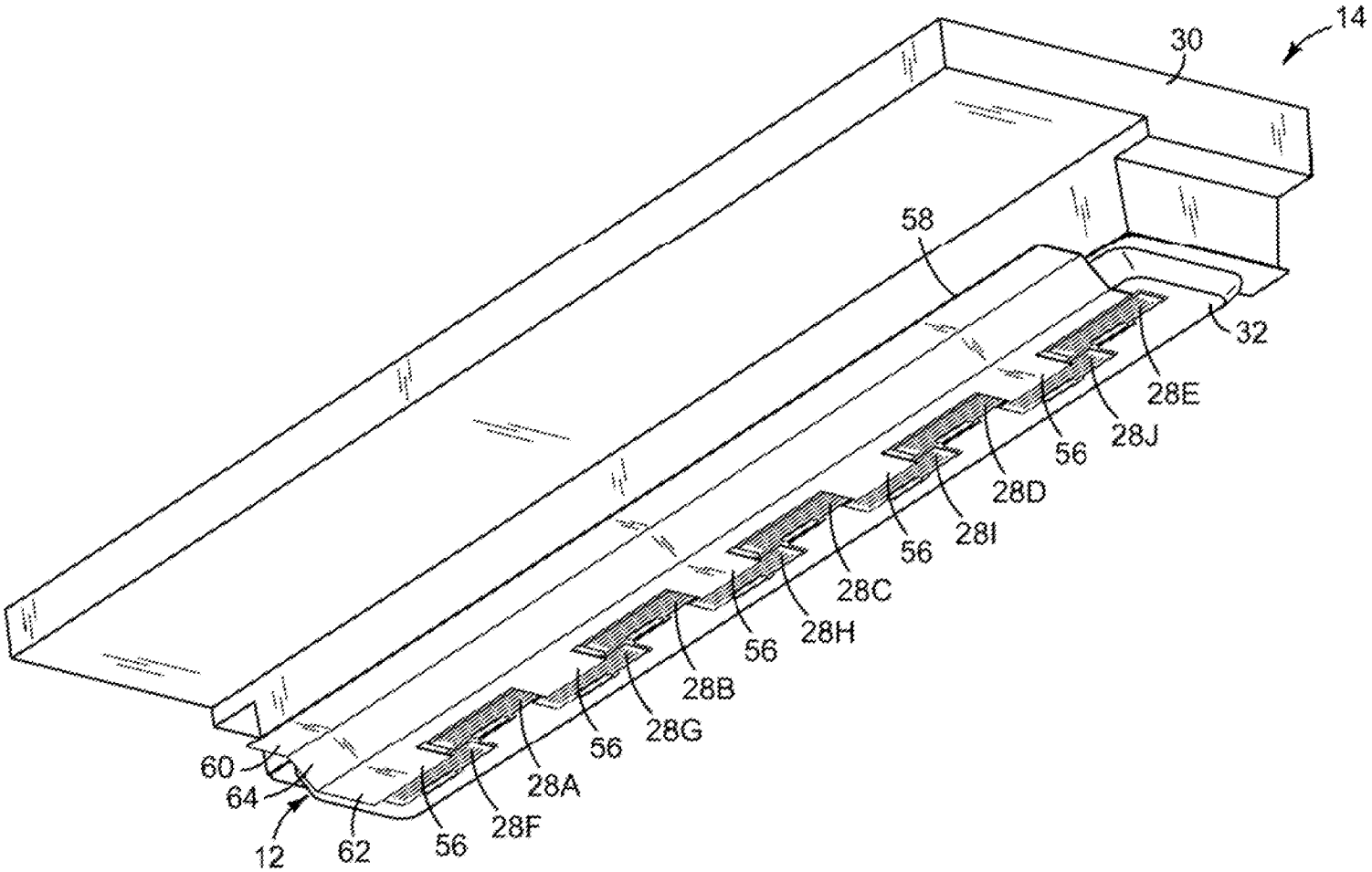
FIG. 8 is a perspective view illustrating another example of a new media guide in which a series of plates are suspended over the print bar, such as might be used in the printer of FIG. 1.
Figure 9:
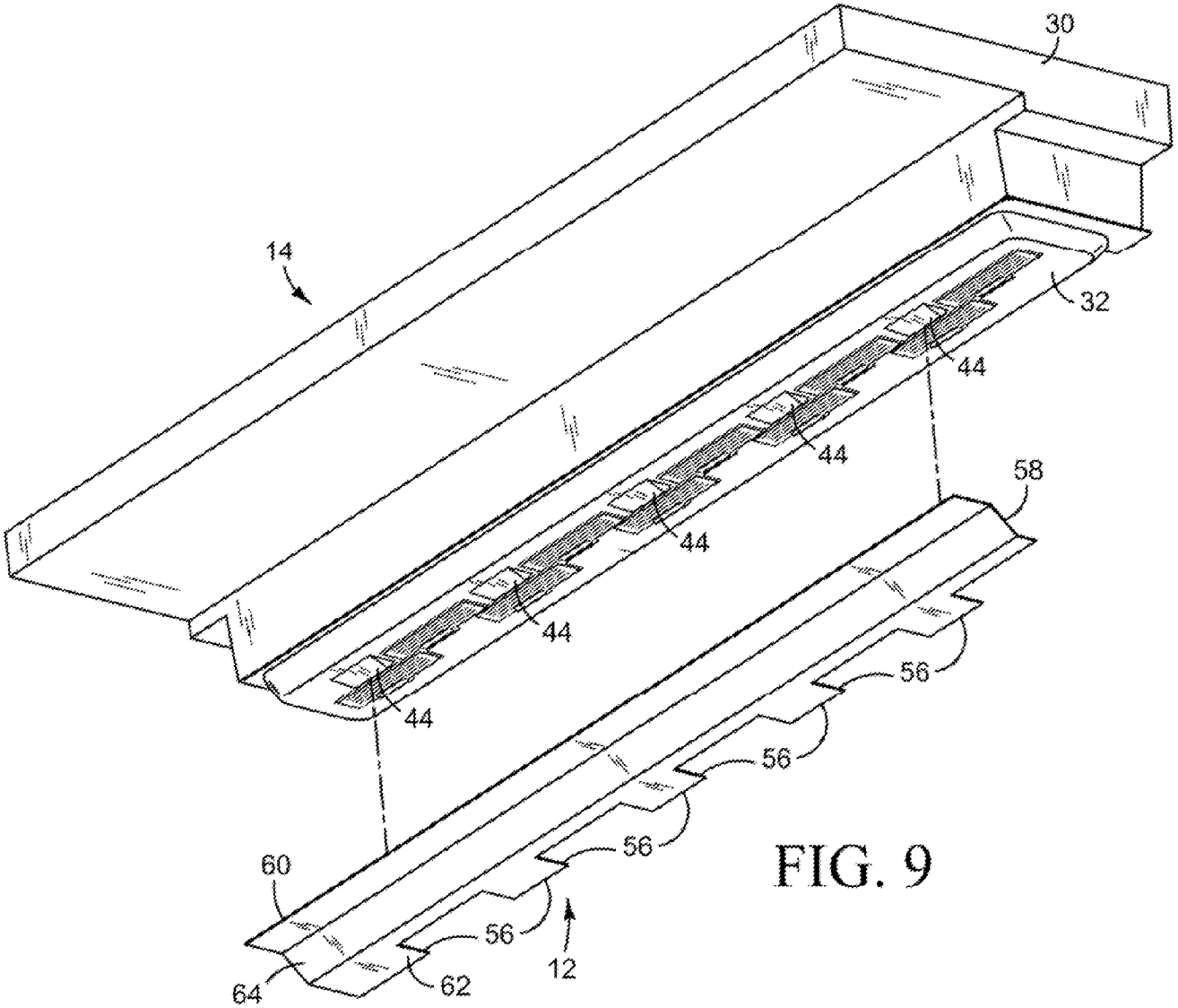
FIG. 9 is an exploded view of the print bar and media guide shown in FIG. 8.
Figure 10:
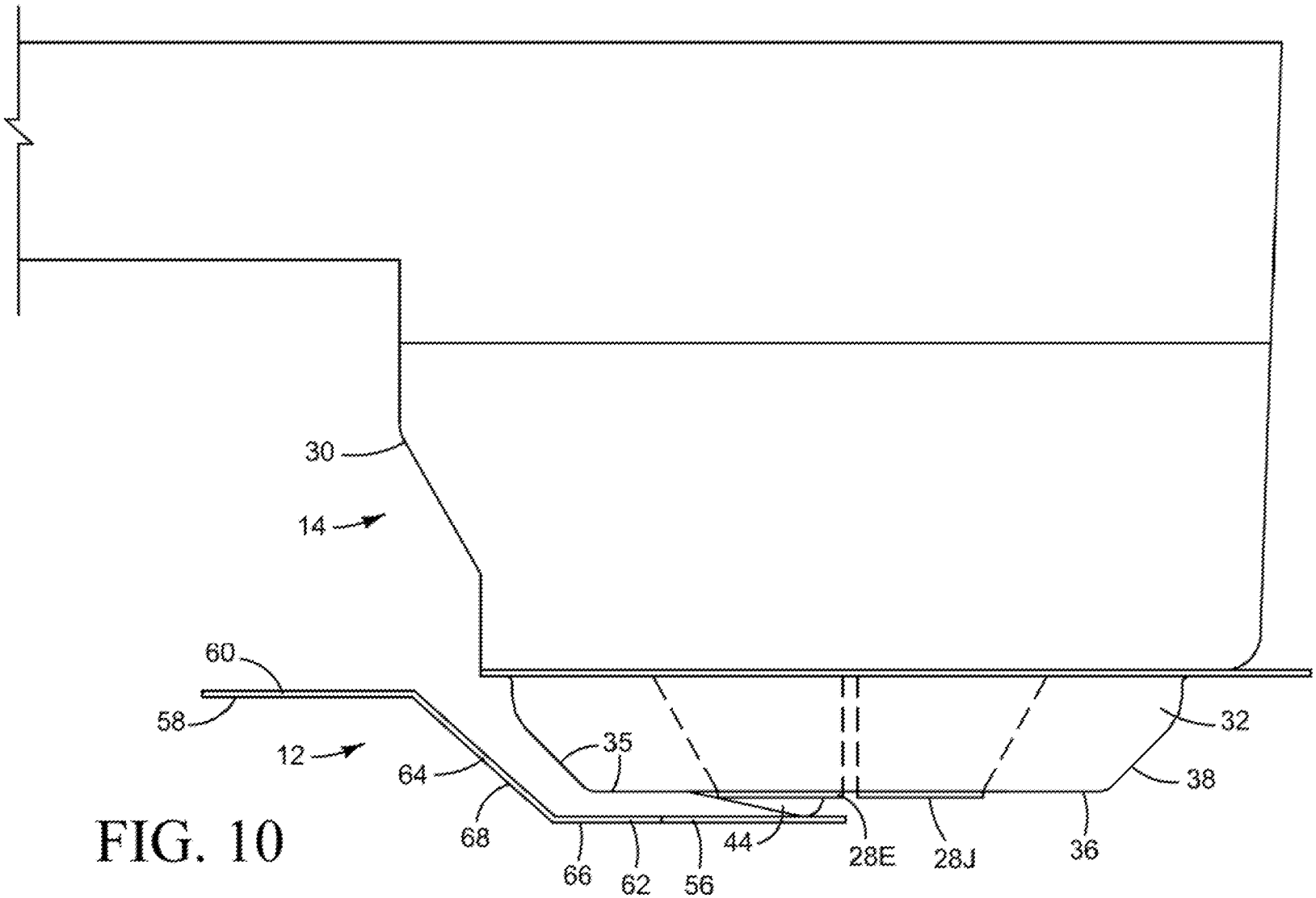
FIG. 10 is a side view of the print bar and media guide shown in FIGS. 8 and 9.

In a second example, shown in FIGS. 8-13, media guide 12 includes a series of plates 56 suspended over print bar 14 at the location of shroud bumps 44. Referring to FIGS. 8-13, media guide 12 includes an elongated generally Z shaped guide 58 with projecting plates 56. For convenience, Z shaped guide 58 is characterized using the parts of the letter Z—a flat upper arm 60, a flat lower arm 62, and a diagonal stem 64 connecting upper and lower arms 60 and 62. Each plate 56 is an extension of lower arm 62. As shown in FIG. 8, lower arm 62 and stem 64 extend continuously across the line of printheads 26A-28J. Although a segmented guide 58 may be used, stem 64 and lower arm 62 should each present a functionally continuous guide surface 66, 68 (FIG. 10) to print media 16. (That is to say, a guide surface 66, 68 that prevents any part of the print media from entering the space between segments.)

Figure 11:
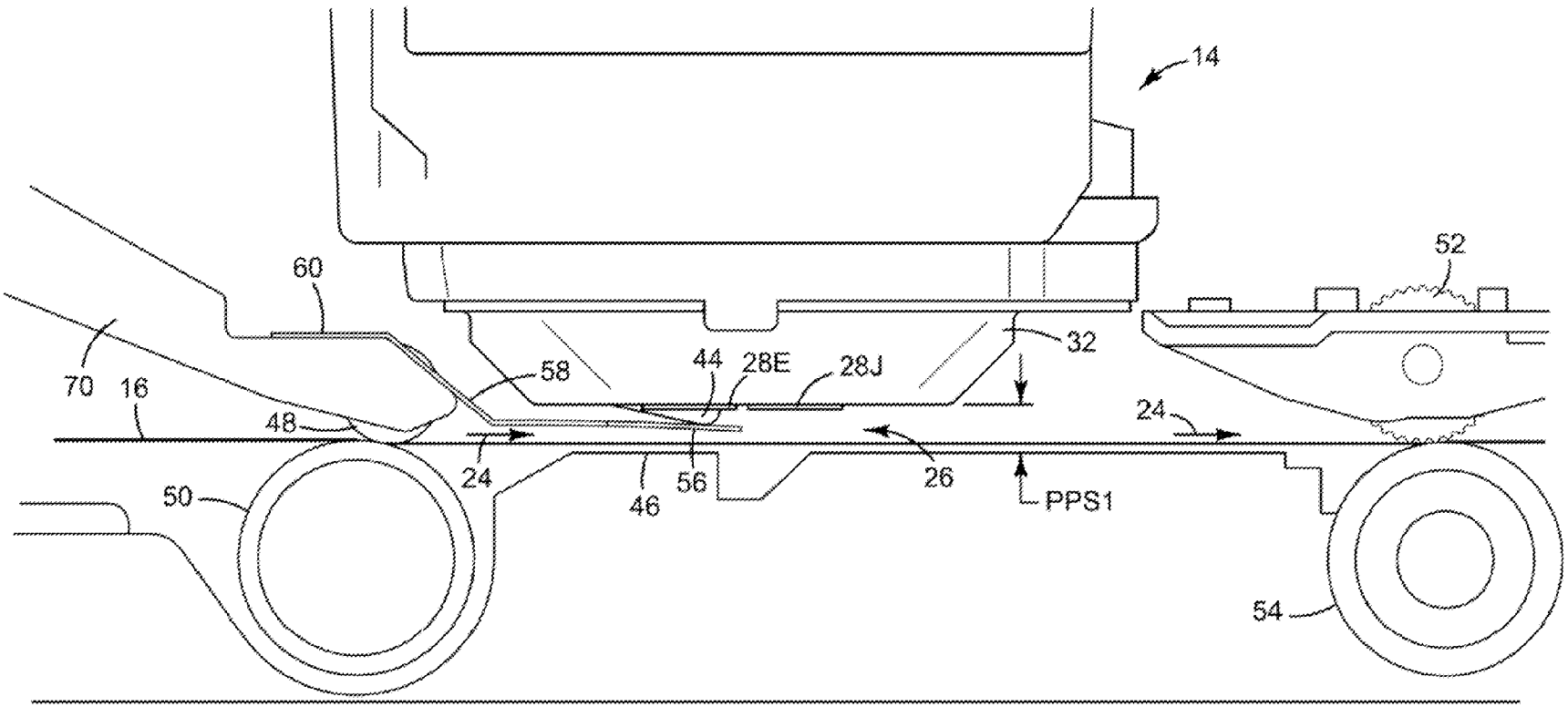
FIGS. 11-13 are side views illustrating one example print zone in an inkjet printer implementing the print media guide shown in FIGS. 8-10. The print bar is in a printing position for thinner media in FIG. 11, in a printing position for thicker media in FIG. 12, and in a raised, servicing position in FIG. 13.
Figure 12:
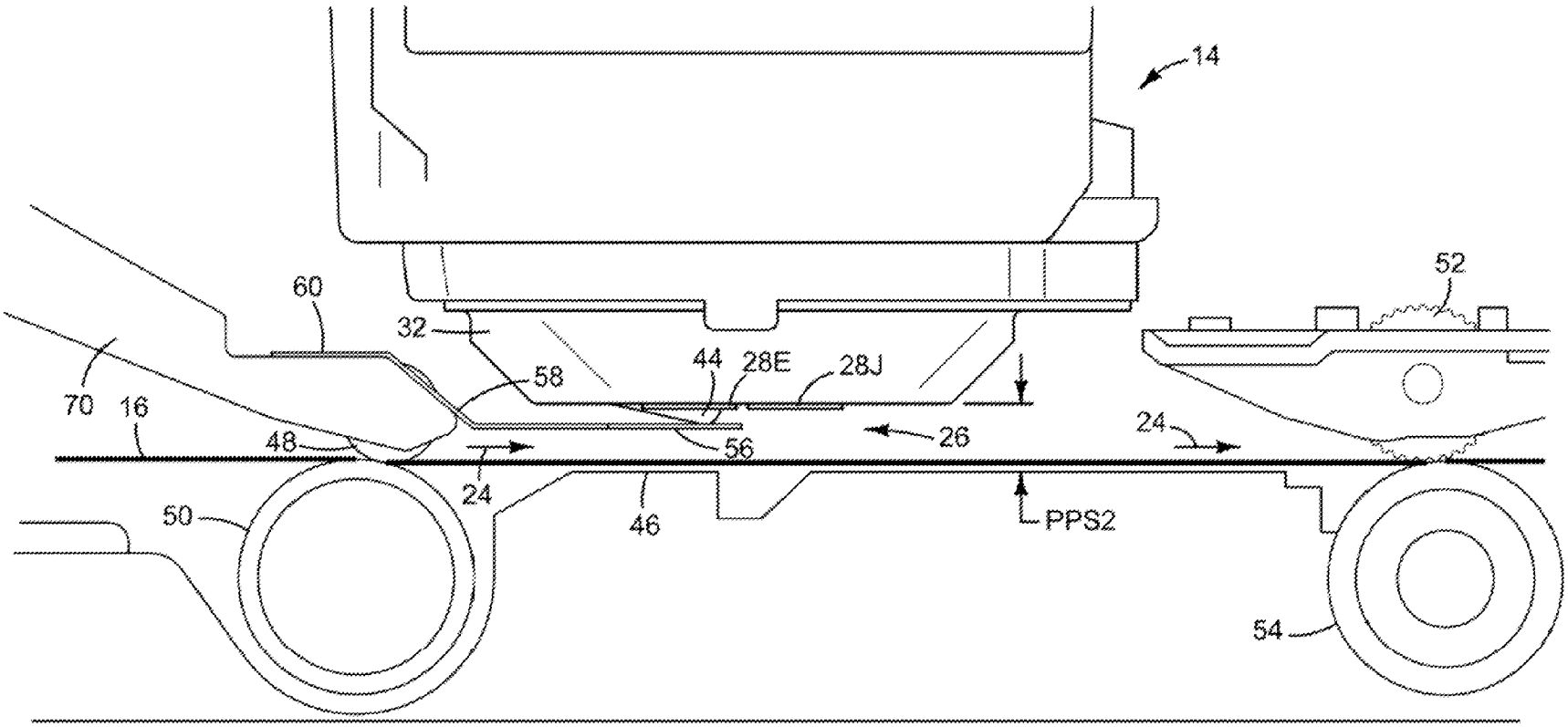
Figure 13:
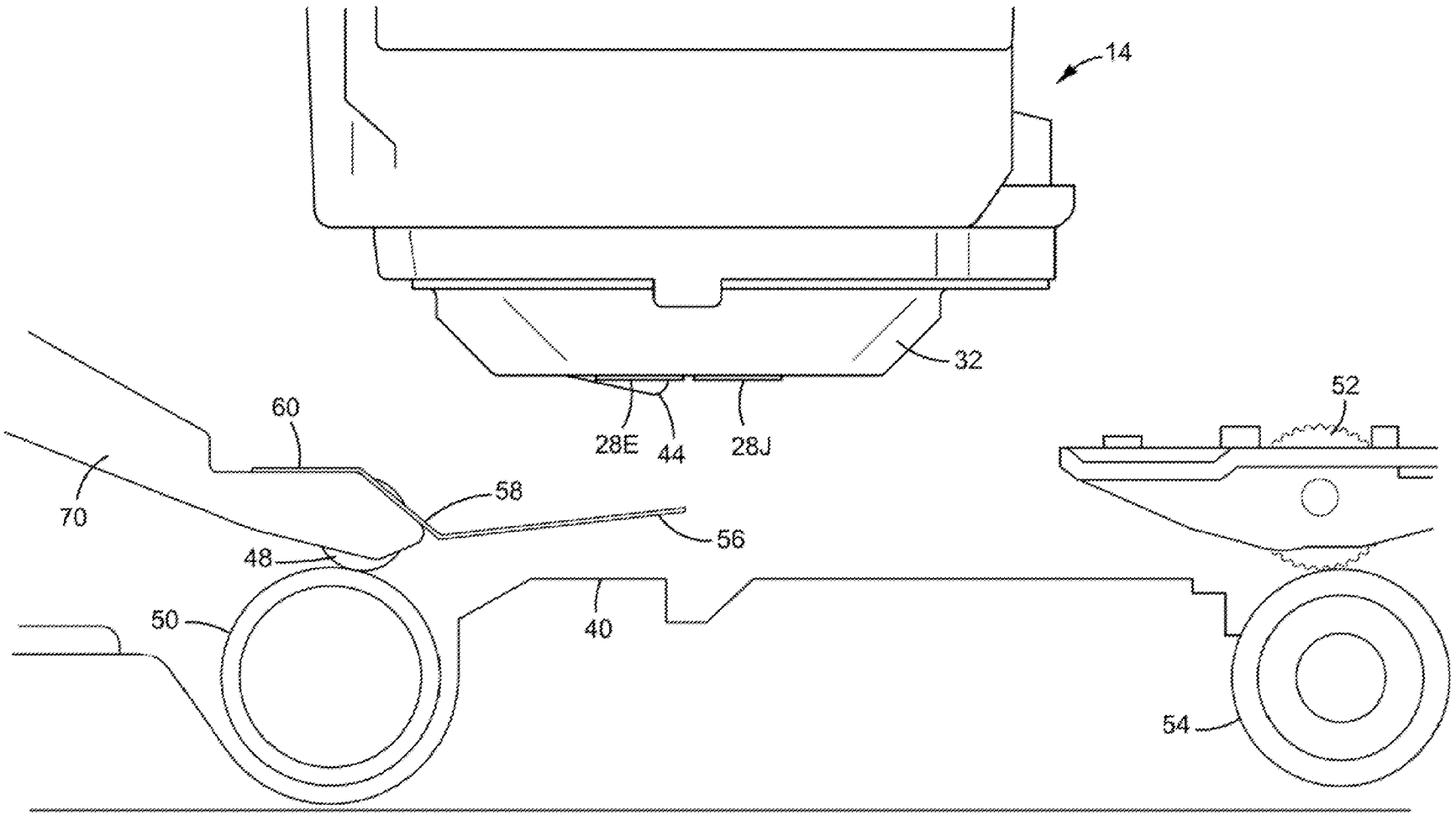

Referring specifically to FIG. 11, upper arm 60 is mounted to the upper entry roller assembly 70 upstream of print one 26. Thus, in this example, guide 58 forms a cantilever that extends out and down from roller assembly 70 into print zone 26. A Z shaped, cantilever guide 58 may be formed from sheet metal or another suitably flexible material to generate a biasing force to hold plates 56 against shroud bumps 44. In this example, bumps 44 function as spacers to maintain an appropriate spacing between plates 56 and printheads 26A-28J. The flexibility/biasing feature also gives plates 56 a small range of motion to stay in contact with bumps 44 if print bar 14 is adjusted to change the PPS (printhead to platen spacing) for printing on different thickness print media 16, as seen by comparing a smaller PPS1 with thinner media 16 in FIG. 11 (where plates 56 are flexed slightly downward) and a larger PPS2 with thicker media 16 in FIG. 12 (where plates 56 are straight), while still clearing the printheads when print bar 14 is raised for servicing, as shown in FIG. 13.

Figure 14:
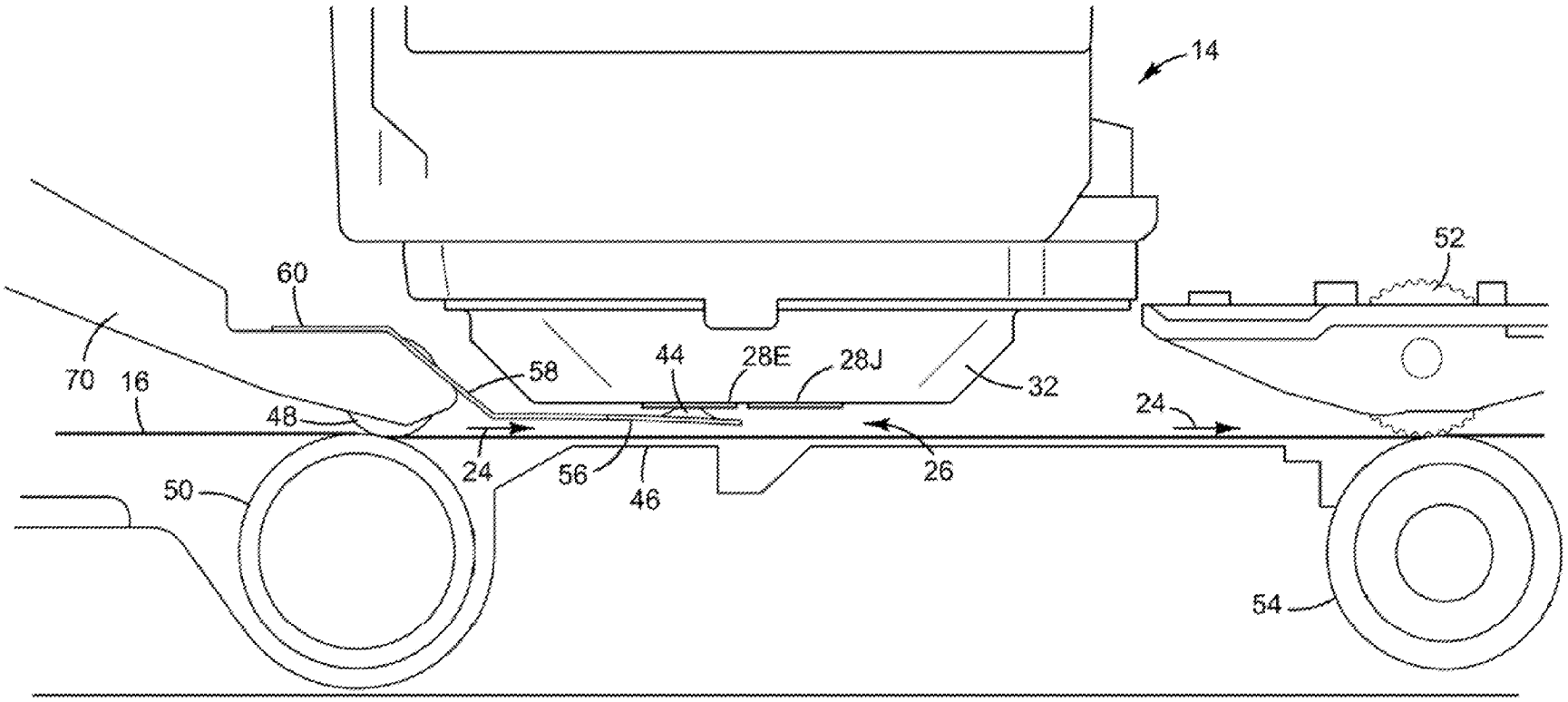
FIGS. 14 and 15 illustrate another example of a new media guide in which spacers are formed on the plates suspended over the print bar.
Figure 15:
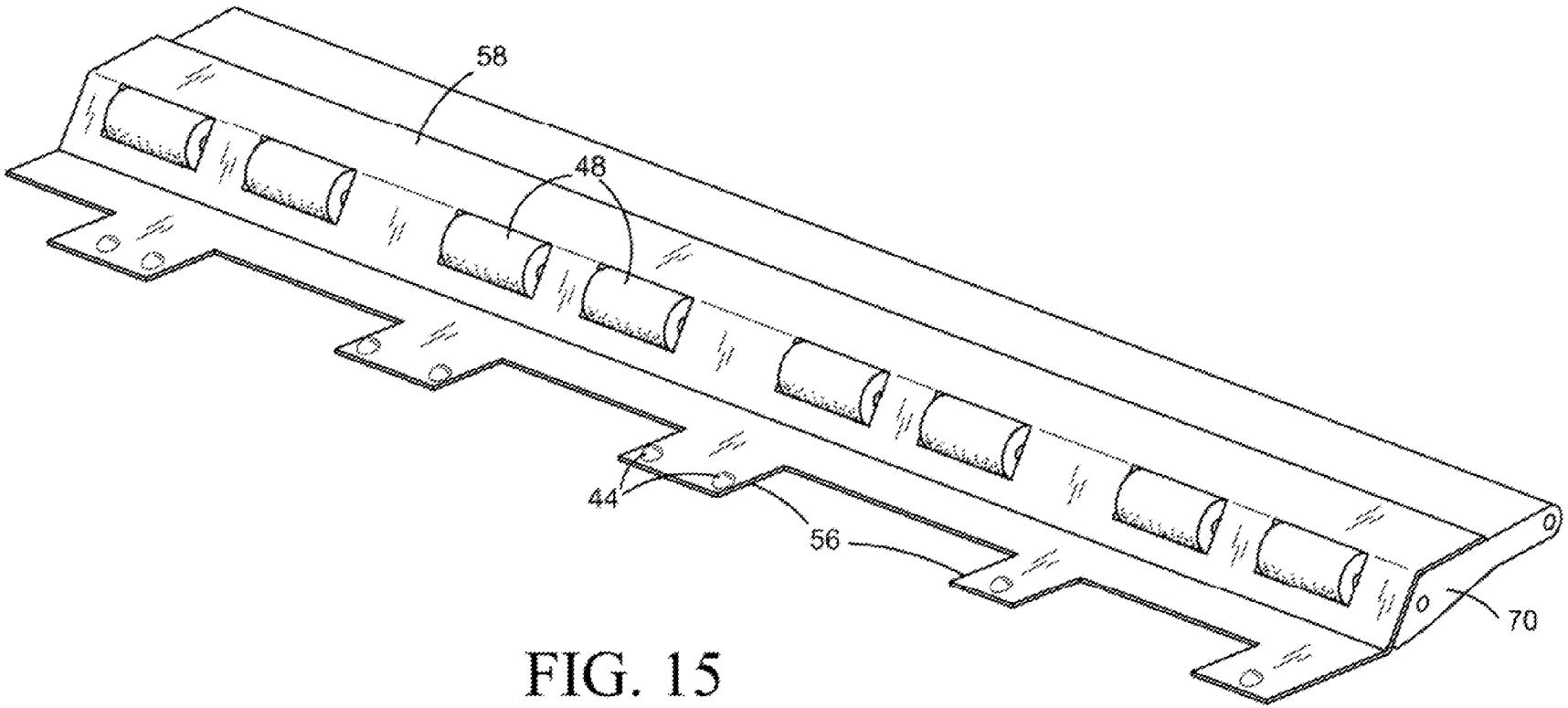

In another example, shown in FIGS. 14 and 15, bumps 44 used with guide 58 are formed on plates 56 (rather than on shroud 32 as in the prior example).

Figure 16:
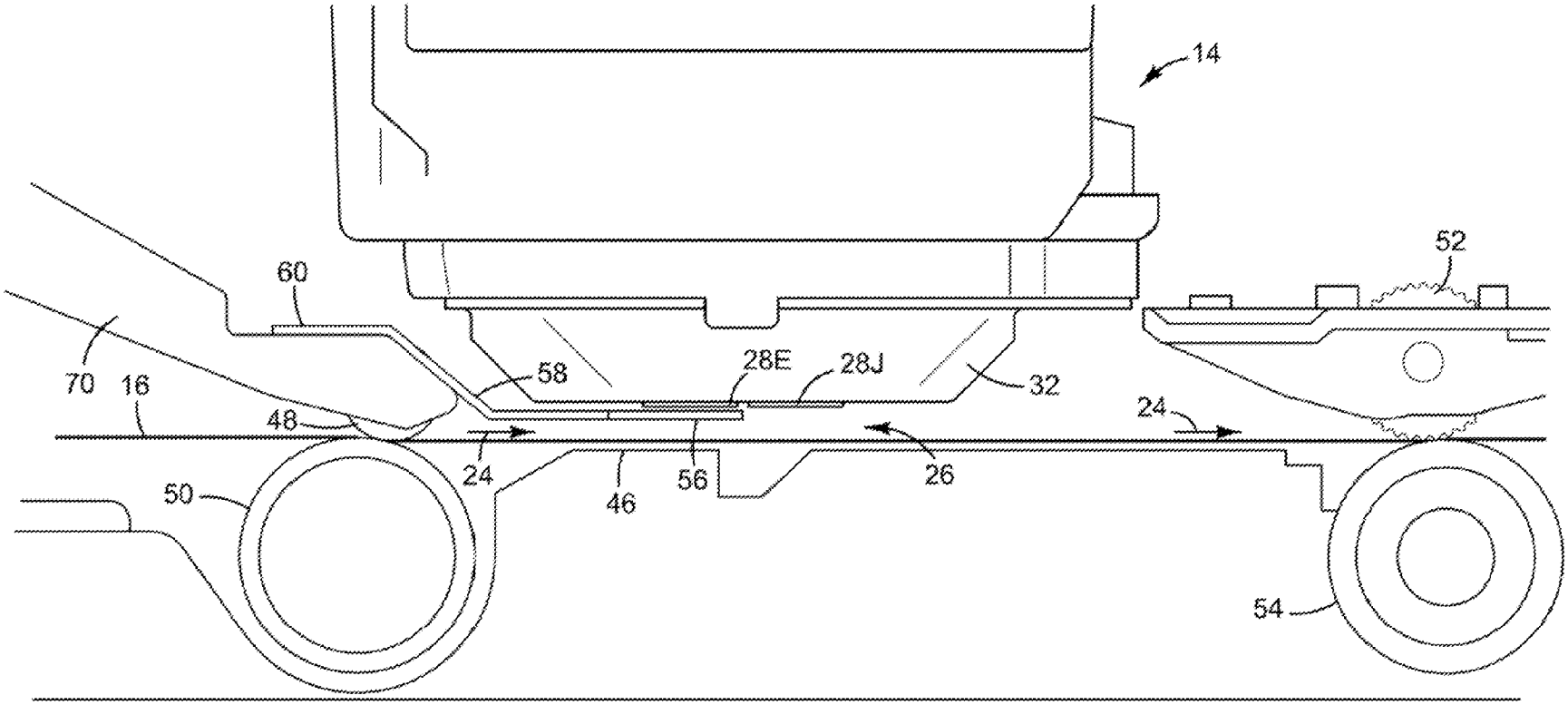
FIG. 16 illustrates another example of a new media guide in which the guide plates are sufficiently rigid to guide the print media without spacers.

On another example, shown in FIG. 16, guide 58 with plates 56 is made sufficiently rigid to guide media 16 without spacer bumps 44.

As noted at the beginning of this Description, the examples shown in the figures and described above illustrate but do not limit the invention. Other examples are possible. Therefore, the foregoing description should not be construed to limit the scope of the invention, which is defined in the following claims.

What is claimed is:

1. A media guide for use with a print bar, the media guide comprising a plate suspended over the print bar to guide a leading edge of print media away from printheads on the print bar during printing when the print bar is installed in a printer, wherein the plate comprises multiple plates each suspended over the print bar between two of the printheads and upstream from another printhead along a print media path when the print bar is installed in a printer.

2. The media guide of claim 1, wherein each plate is integral to a single part includes two or more of the plates.

3. The media guide of claim 1, wherein each plate is suspended over the print bar a first distance greater than a second distance the printheads protrude from the print bar.

4. The media guide of claim 3, wherein:

the printheads are arranged on the print bar in a staggered, overlapping configuration in which each printhead is either upstream or downstream from and overlaps an adjacent printhead along the media path; and each plate is located between upstream printheads immediately upstream from a downstream printhead.

5. A media guide for use with a print bar, the media guide comprising:

multiple plates over the print bar to guide a leading edge of print media away from printheads on the print bar; and multiple spacers between the plates and the print bar to maintain a first distance between each plate and the print bar greater than a second distance the printheads protrude from the print bar.

6. The media guide of claim 5, wherein each plate is suspended over the print bar and biased against a spacer.

7. The media guide of claim 6, wherein the spacers are formed on or affixed to the print bar.

8. The media guides of claim 6, wherein the spacers are formed on or affixed to the plates.

9. The media guide of claim 6, further comprising a biasing mechanism to bias the plate against the print bar.

10. The media guide of claim 9, wherein the plate comprises a flexible plate and the biasing mechanism comprises a flex in the plate.

11. A device comprising:

a support structure;

multiple printheads supported by the support structure; and multiple media guides each located near a corresponding one of the printheads, each media guide configured to block a leading edge of print media from contacting the corresponding printhead and the multiple guides collectively configured to guide the leading edge of the print media away from all of the printheads.

12. The device of claim 11, wherein:

the printheads are arranged on the support structure in a staggered, overlapping configuration in which each printhead is either upstream or downstream from and overlaps an adjacent printhead along a media path; and each guide is located between upstream printheads immediately upstream from a downstream printhead.

13. The device of claim 12, wherein each guide comprises a plate suspended between two of the printheads and upstream from another printhead.

14. The device of claim 12, further comprising a shroud to protect the printheads and wherein each guide comprises a bump on the shroud between two of the printheads and upstream from another printhead.

* * * * *